United States Patent [19]

Szkaradek

[11] Patent Number: 4,513,917

[45] Date of Patent: Apr. 30, 1985

[54] SAND MILL ROTOR DISCS

[75] Inventor: Edward J. Szkaradek, Santa Ana, Calif.

[73] Assignee: Morehouse Industries, Inc., Fullerton, Calif.

[21] Appl. No.: 504,937

[22] Filed: Jun. 16, 1983

[51] Int. Cl.[3] ..... B02C 17/16

[52] U.S. Cl. ..... 241/46.11; 241/46.17; 241/172

[58] Field of Search ..... 241/172, 46.17, 46.11

[56] References Cited

U.S. PATENT DOCUMENTS 3,432,109 3/1969 Geissel ..... 241/172
4,066,215 1/1978 Pujol ..... 241/172 X

FOREIGN PATENT DOCUMENTS 2520114 11/1976 Fed. Rep. of Germany ..... 241/172
104658 8/1980 Japan ..... 241/172

*Primary Examiner*—Mark Rosenbaum
*Attorney, Agent, or Firm*—Knobbe, Martens, Olson & Bear

[57] ABSTRACT

A rotor disc for a sand mill is formed with a rim which is considerably thicker in the axial direction than the web extending between the rim and the hub of the disc. This improves the milling operation and extends the life of the disc. Forming the rim and hub of an abrasively tough, high molecular weight material, such as polyethyelene instead of steel, further extends the life of the rotor disc by reducing wear and also reducing contamination of the product being processed. Ceramic materials also provide excellent wearability.

18 Claims, 3 Drawing Figures

SAND MILL ROTOR DISCS

BACKGROUND OF THE INVENTION

This invention relates to industrial milling apparatus for grinding or milling small solid particles contained in liquid, and more particularly relates to an improved rotor disc which agitates a grinding media as the liquid is pumped through a milling vessel.

Sand milling is a proven, practical, continuous, high-production method of dispersing and milling particles in liquid to produce smooth, uniform, finely dispersed products. One good example of this is the disbursement of pigment agglomerates in paints. The process is also applicable to the wide variety of inks, dye stuffs, paper coatings, chemicals, magnetic tape coatings, insecticides and other materials where millings of a high degree of fineness is required.

In a typical sand milling process, the material or slurry to be processed is introduced at the bottom of the processing chamber or vessel and pumped upwardly through a grinding media, which used to be sand, but is now more commonly small diameter metal shot, manufactured grit or glass beads. A rotor including a shaft and a series of discs positioned within the vessel mills the slurry as it is pumped through the media.

The rotor discs have typically been generally flat disc-like elements having axially extending holes through which the liquid moves when being processed through the vessel. It can be appreciated that the grinding media which reduces the size of the particles in the liquid pumped through the vessel also is very abrasive on the rotor discs. Typically, the discs have been made of a specially hardened metal such as chrome 250 alloy to enhance wearability. Nevertheless, the continuous rotation of the rotor discs gradually wears away the disc material making them thinner and thinner until the outer rim or periphery of the disc actually wears to a knife edge.

Thus, it is desirable that the life of the rotor discs be extended. Replacement of rotor discs includes not only the cost of the discs themselves but the substantial amount of labor required, as well as the lost operational time of the apparatus.

It is also always desirable to improve the efficiency of the milling operation.

SUMMARY OF THE INVENTION

In accordance with this invention, there is provided a sand mill rotor disc which includes a rim that is substantially thicker in the axially direction than is the web portion of the disc which extends between the rim and the disc hub. This construction improves the agitation of the grinding media and hence the efficiency of the milling operation. Rotor discs tend to direct media and product flow radially outwardly by centrifugal force. It is believed that the disc rims deflect this flow axially causing it to mix turbulently with a similar stream generated by the adjacent disc. The axially thickened rims also extend the useful life of a disc beyond that of the prior rotors having discs of substantially uniform thickness extending away from the hub. The greatest wear on a rotor disc occurs at its periphery because the periphery travels a greater distance per revolution in contact with the abrasive grinding media then does the web portion closer to the hub. Thus by having the rim thicker than the web, the life of the disc is improved.

In the preferred form of the invention, the disc rim tapers axially from the web portion to its maximum thickness thus providing an inclined surface that helps redirect the flow of material. While various rim thicknesses may be utilized, it is desirable that the rim be thicker than the web.

DETAILED DESCRIPTION

Figure 1:
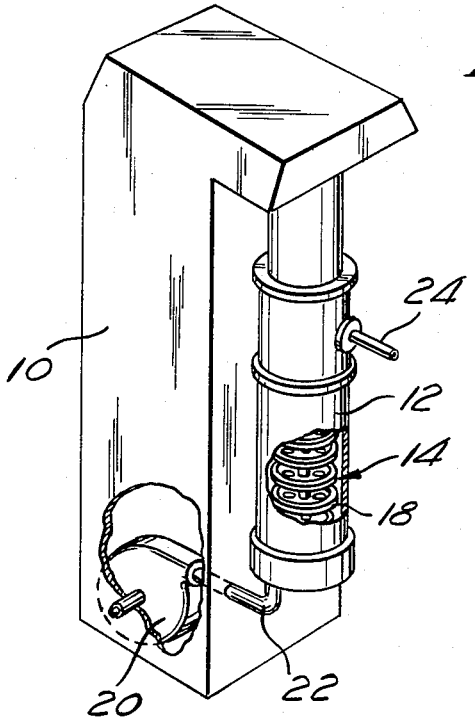
FIG. 1 is a perspective schematic illustration of a sand mill employing the rotor discs of the invention.

The sand mill schematically illustrated in the drawing includes a support column 10 supporting on one side a sand mill vessel 12. Within the vessel there is positioned a rotor 14 including a shaft 16 and a plurality of axially spaced rotor discs 18. A pump 20 connected to an inlet 22 at the lower end of the vessel pumps liquid upwardly to exit the vessel at its upper end through an outlet 24. A motor (not shown) is positioned in the upper end of the support column 10 and is typically connected by a pulley and belt arrangement (not shown) to rotate the rotor. Also positioned in the vessel is a quantity of grinding media 25 preferably formed of a small diameter shot made of steel or other suitable long-wearing material.

Figure 2:
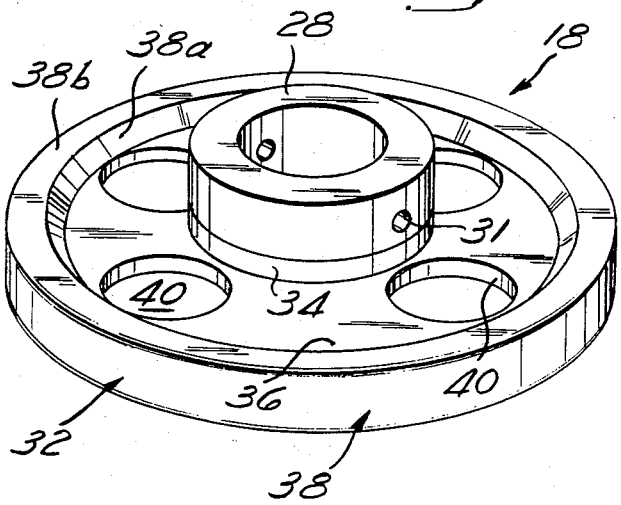
FIG. 2 is a perspective view of one sand mill rotor disc.
Figure 3:
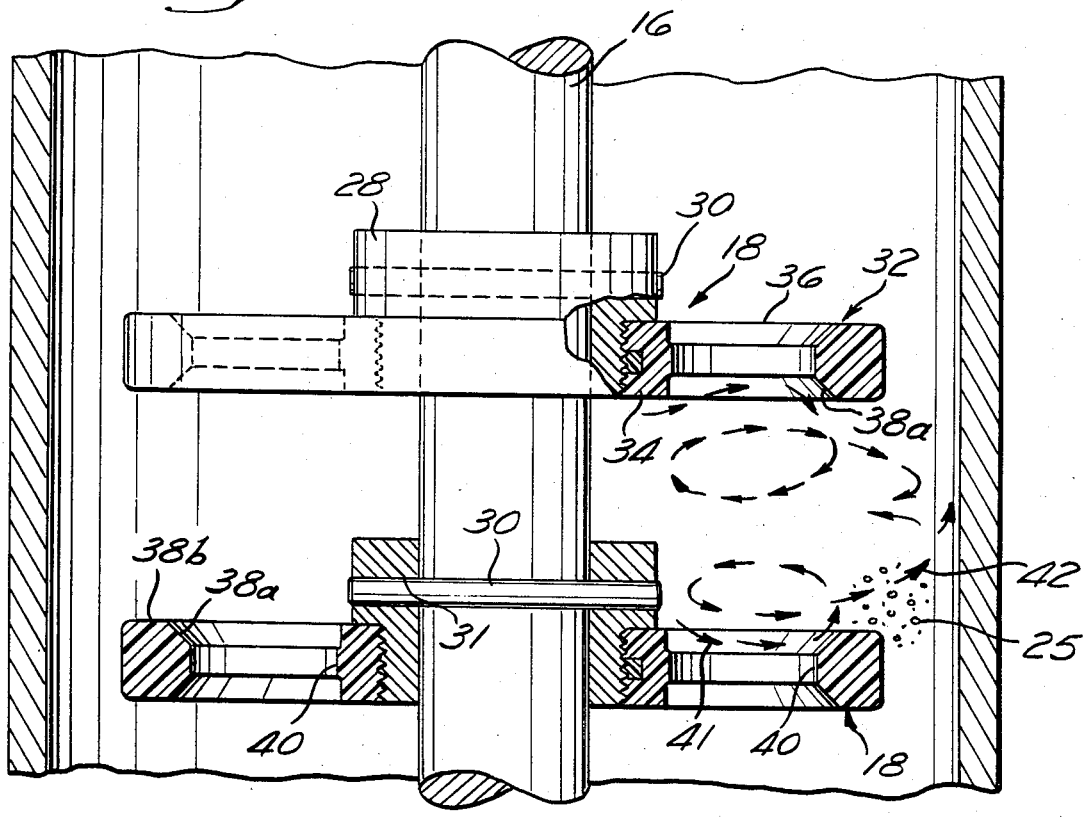
FIG. 3 is a partially sectionalized view of a portion of the sand mill rotor.

Referring to FIGS. 2 and 3, it may be seen that a rotor disc 18 includes a tubular hub 28 secured to the shaft 16 by a pin 30 which extends diametrically through a hole 31 in the hub and in the shaft. Threaded to this hub is a separate one-piece disc member 32 which includes a hub portion 34 which mates with the primary hub 28, a flat annularly shaped web 36 and an outer rim 38. In addition to the threaded connections there is preferably provided at least two plug-type, deformable connectors, such as those sold under the trademark Ny-Lok. As may be seen, the rim includes an inner portion **38*a* that tapers axially and outwardly to the peripheral portion 38*b* of the rim which is considerably thicker than the web 36 and is about equal to the axial thickness of the hub portion 34**.

The web is formed with a plurality of axially extending equally spaced ports 40 through which the slurry being processed can flow as it is being pumped through the vessel. The ports are relatively large extending from the hub portion 34 to the rim 38.

The disc may be formed with the entire hub web and rim as an integral unit and may be made of steel. However, as one feature of the invention, the disc member 32 is preferably made of an abrasively tough, resilient material having an ultra high molecular weight, such as polyethylene, one such polyethylene is available from Cadillac Plastics of Anaheim, Calif., under the designation UHMW 1900 polyethylene. The hub 28, on the other hand, is preferably made of steel in that there is less wear on the hub area and steel can accommodate a torque load better than polyethylene. This arrangement is also desirable from the standpoint that the disc member 32 may be replaced without replacing the hub 28. In some applications, another desirable alternative is to utilize a disc member made of a ceramic material, and threaded or pinned to a steel hub. One example of a suitable ceramic is aluminia sold by Coors of Golden Colorado under the tradename "SERASURF". Such material is very resistant to abrasion and can withstand high heat.

In one sand mill of a relatively small size, a disc having a 10 inch diameter was formed with a web of $\frac{3}{8}$ inches thick and a rim 1 inch thick. Thus the rim is two to three times as thick as the web. The radial thickness of that rim is about 1 inch extending from the web to the periphery of the disc, while the web has a radial dimension of about 2 inches. Or in other words, the web is about twice as long in the radial dimension as is the rim.

In operation of the sand mill with the rotor agitating the grinding media and with the product to be processed being pumped upwardly through the mill, it has been found that the flow of material adjacent to the rotor disc is initially radiated outwardly as shown by the arrows 41 but that the flow is then deflected axially towards the adjacent disc, somewhat as shown by the arrows 42 in FIG. 3. With two such flows being directed towards each other, a considerable amount of turbulence in mixing between these two streams occurs. This performance has been observed utilizing a transparent vessel and a video tape recorder to record the operation.

As mentioned above, the desired spacing between the axially face of one rim and the opposing axial face of an adjacent rim is about three times the thickness of a rim. Or as stated differently, the spacing between the radial center line of one disc and that of the radial center line of an adjacent disc is about four times the axial thickness of a disc rim.

As mentioned above, the abrasive grinding media eventually wears away the rotor discs. This wear is greatest at the periphery of the discs since the distance travelled by the periphery is greater than that inwardly. Thus, by utilizing the thickened rim, the wear pattern of the disc is made more uniform, so that by the time the rim is worn to some minimum thickness, the web portion also requires replacement.

Making the web and rim of a one-piece, high density polyethylene member also greatly enhances the life of the rotor disc in that polyethylene has been found to be very abrasively tough and resistant to such wear. Likewise, making the structure out of ceramic improves wearability in an abrasive environment.

Another advantage of the thick rim is that the improved mixing patterns and enhanced grinding action means that rotor speed could be reduced from that used with flat disks in accomplishing a desired result. This, in turn, reduces heat generation, which is particularly important in some operations.

I claim:

1. Industrial milling apparatus for reducing the size of particles in liquid including a vessel, a rotor in said vessel having a shaft and a plurality of axially spaced rotor discs mounted on the shaft, a quantity of grinding media in the vessel to be agitated by said rotor as the liquid is pumped through the vessel, the improvement wherein:

said rotor discs each have a hub attached to the shaft, a generally planar, annular web extending out from the hub, the web being of substantially uniform thickness throughout its annular shape except for having a plurality of enlarged ports extending axially through the web for permitting the liquid and media to circulate in the vessel, and an annular rim extending outwardly from the web having an uninterrupted and substantially uniform axial thickness considerably greater than the axial thickness of the web.

2. The apparatus of claim 1 wherein the rim is more than twice the axial thickness of the web.

3. The apparatus of claim 1 or 2 wherein the rim includes a transition portion which tapers axially and radially outwardly from the web to a rim portion of greater axial thickness.

4. The apparatus of claim 1 or 2 wherein the spacing between the rims of adjacent discs is approximately three times the axial thickness of the rims.

5. The apparatus of claim 1 wherein the axial spacing of said discs from the radial centerline of one disc to the radial centerline of the adjacent disc is approximately four times the thickness of the rim of a disc.

6. The apparatus of claim 1 or 2 wherein the diameter of a disc is about ten times the rim thickness.

7. The apparatus of claim 1 or 2 wherein the radial thickness of the disc rim is about equal to its axial thickness.

8. The apparatus of claim 1 wherein the ports extend substantially from the hub to the rim.

9. The apparatus of claim 1 or 2 wherein said hub is made of metal while the web and rim are made of an abrasively tough plastic material, such as polyethylene.

10. The apparatus of claim 9 wherein said web and rim are made of one piece and the web threads onto said hub.

11. The apparatus of claim 9 wherein said hub is axially thicker than the web and the hub is secured to the shaft by means axially offset from the web.

12. The apparatus of claim 1 wherein the ratio of a rim axial thickness to web thickness is about eight to three.

13. The apparatus of claim 1 wherein the hub is made of metal and the web and rim are made of a separate ceramic member which is mounted on the hub.

14. The apparatus of claim 1 wherein the web and the rim extend radially with the radial dimension of the web being about twice the radial dimension of the rim and of the rim and the web extending axially, with the axial thickness of the rim being at least twice of that of the web.

15. The apparatus of claim 1 wherein the outer diameter of the disc rim portion is about twice that of the outer diameter of the hub portion.

16. In an industrial milling apparatus having a generally cylindrical vessel, grinding media in the vessel, a rotor rotatably mounted in the vessel including a shaft and a plurality of discs axially spaced on the shaft for agitating the media as a liquid/solid slurry is pumped through the vessel, the improvement wherein:

each of said rotor discs has a hub attached to the shaft, an annular web attached to the hub having a generally uniform thickness except for a plurality of large, axially extending ports through which the slurry can flow, and an annular rim formed integral with the web, and tapering axially from the web to a uniform, uninterrupted axial thickness considerably greater than that of the web so that the grinding media and product being propelled radially outwardly by a disc web is directed axially by the rim towards a similar flow from the adjacent disc to enhance thorough mixing and agitation of the media and the product.

17. The apparatus of claim 16 wherein said hub is made of metal while the web and rim are made of an abrasively tough plastic material, such as polypropylene.

18. The apparatus of claim 16 wherein said hub is made of metal while the web and rim are made of ceramic.

* * * * *